US007995777B2

(12) United States Patent
Yu et al.

(10) Patent No.: US 7,995,777 B2
(45) Date of Patent: Aug. 9, 2011

(54) THIN FILM TRANSPARENT ACOUSTIC TRANSDUCER

(76) Inventors: Xun Yu, St. Paul, MN (US); Rajesh Rajamani, Saint Paul, MN (US); Kim A. Stelson, Edina, MN (US); Tianhong Cui, Vadnais Heights, MN (US)

( * ) Notice: Subject to any disclaimer, the term of this patent is extended or adjusted under 35 U.S.C. 154(b) by 1338 days.

(21) Appl. No.: 11/538,135

(22) Filed: Oct. 3, 2006

(65) Prior Publication Data

US 2007/0081681 A1 Apr. 12, 2007

Related U.S. Application Data

(60) Provisional application No. 60/723,250, filed on Oct. 3, 2005.

(51) Int. Cl.
*H04R 25/00* (2006.01)

(52) U.S. Cl. ..... 381/191; 381/190

(58) Field of Classification Search ..... 381/190, 381/191, 399, 369, 173–176, 178, 355, 386; 310/328

See application file for complete search history.

(56) References Cited

U.S. PATENT DOCUMENTS

| | | | | |
|---|---|---|---|---|
| 3,792,204 | A | 2/1974 | Murayama et al. | |
| 6,630,772 | B1 | 10/2003 | Bower et al. | |
| 6,699,642 | B2 | 3/2004 | Chung et al. | |
| 7,095,864 | B1 * | 8/2006 | Billson et al. | 381/191 |
| 2002/0181715 | A1 | 12/2002 | Kang et al. | |
| 2004/0022981 | A1 | 2/2004 | Hu et al. | |
| 2004/0038007 | A1 | 2/2004 | Kotov et al. | |
| 2004/0197546 | A1 | 10/2004 | Rinzler et al. | |
| 2004/0217336 | A1 | 11/2004 | Niu et al. | |
| 2004/0265550 | A1 | 12/2004 | Glatkowski et al. | |
| 2005/0081625 | A1 | 4/2005 | Chen et al. | |

FOREIGN PATENT DOCUMENTS

| | | |
|---|---|---|
| JP | 61166300 | 7/1986 |
| JP | 4070100 | 3/1992 |
| JP | 2004261713 | 9/2004 |
| JP | 2004315786 | 11/2004 |
| WO | WO-03085049 | 10/2003 |
| WO | WO-2005043639 | 5/2005 |
| WO | WO2008091402 | 7/2008 |

OTHER PUBLICATIONS

Lee, C. S., et al., "Flexible and transparent organic film speaker by using highly conducting PEDOT/PSS as electrode", *Synthetic Metals*, 139(2), (Sep. 5, 2003),457-461.

(Continued)

*Primary Examiner* — Tuan D Nguyen
(74) *Attorney, Agent, or Firm* — Schwegman, Lundberg & Woessner, P.A.

(57) ABSTRACT

A thin film acoustic transducer is formed with an electrically actuatable substantially transparent thin film. Substantially transparent conductive thin films are supported on both sides of the electrically actuatable substantially transparent thin film. The thin film transducer may be used to sense sound, or produce sound in various embodiments. In further embodiments, the film may be attached to a window, and operate as a speaker for an audio system, or may provide noise cancellation functions. In further embodiments, the film may be attached to a computer monitor, touch panel, poster, or other surface, and operate as a speaker. A method of forming carbon nanotube thin films uses a layer by layer assembly technique and a positively charged hydrophilic layer on a thin film substrate.

19 Claims, 4 Drawing Sheets

OTHER PUBLICATIONS

Schmid, G. , et al., "Small Dimensions and Material Properties: A Definition of Nanotechnology", *Final report of the Europäische Akademie's study group—Miniaturization and Material Properties*., (Nov. 2003),1-135.
Teo, Kenneth B., et al., "Catalytic synthesis of carbon nanotubes and nanofibers", *Encyclopedia of Nanocience and Nanotechnology*, (2003),1-22.
Wu, Zhuangchun , et al., "Transparent, Conductive Carbon Nanotube Films", *Science*, 305(5688), (Aug. 27, 2004),1273-6.
Glatkowski, Paul J., "Carbon Nanotube Based Transparent Conductive Coatings", Eikos Inc., [Online]. Retrieved from the Internet: <http://www.eikos.com/articles/conductive_coatings.pdf>, (Retrieved Feb. 1, 2011), 1-7.

* cited by examiner

THIN FILM TRANSPARENT ACOUSTIC TRANSDUCER

This application claims benefit of priority to U.S. Provisional Application No. 60/723,250, filed Oct. 3, 2005 which application is incorporated herein by reference.

FIELD

The present application relates to acoustic transducers, and in particular to thin film transparent acoustic transducers.

BACKGROUND

The continued growth in urban population has led to high-density housing close to airports and highways. This has increased the exposure of the population to noise from a variety of sources, increasing the need to provide better sound insulation for the homes. For homes close to airports and highway, windows constitute the primary path through which noise enters a home. Therefore, window improvements provide the most satisfaction to home dwellers. According to many research results, the development of double-glazed windows with embedded active control systems can be an effective approach to reduce noise impact on homes.

One great challenge for an active noise control system for windows is the need for the actuators to be transparent. One approach that has been investigated by other researchers is to place loudspeakers on the sides of the cavity of double-glazed windows as secondary sources. However, this cavity control approach is not effective in controlling the panel radiation-dominated sound. Another approach is to use a small voice-coil actuator to vibrate the glass panel itself to generate the canceling sound. Although significant reduction in noise transmission is possible at the location of actuator, global noise cancellation over the entire panel with a single point actuator can be achieved only when the length of the panel is less than one-fifth of the sound wavelength in the air (e.g., 0.14×0.14 m2 for frequencies up to 500 Hz). Such a small panel is not practical for a real window application. Using multiple voice coil actuators is also not practical, since several actuators on a window pane would again destroy the aesthetics of the window. There is a need for transparent speakers that can provide distributed canceling sound over the entire surface of a large sized glass panel. The need of transparence for the windows application poses a great challenge to the development of such speakers.

Several research groups have investigated different methods for the development of thin film acoustic actuators. One prior method uses an electroacoustic loudspeaker that uses the electrostrictive response of a polymer thin film. Over 80 dB sound pressure level can be produced from the "bubble" elements of such loudspeakers. However, the high resonant frequency (about 1500 Hz), the experienced harmonic distortion, and required high driving electric field (25 V/μm) will prohibit its use from most applications. Piezoelectric effect is another mechanism that can be employed to fabricate loudspeakers. Among the piezoelectric polymers, polyvinylidene fluoride (PVDF) has been mostly studied due to its strong piezoelectric effect. Recently, PVDF has been investigated for the active noise and vibration control, either being used as sensor, actuator, or both. However, the need of transparency for the electrodes still poses a challenge.

Transparent conductive thin films electrodes are also widely used for liquid crystal displays (LCDs), touch screens, solar cells and flexible displays. Due to high electrical conductivity and high optical transparency, indium tin oxide (ITO) thin films are often used in these applications. Typically, ITO thin films need to be deposited or post annealed at high temperatures to achieve an optimal combination of electrical and optical properties, which is much higher than the Curie temperature of PVDF. PVDF will lose desired piezoelectric properties at such high temperatures. Another shortcoming of ITO films prepared by such conventional methods is their brittleness. A 2% strain will make the films crack and thus lose conductivity. Antimony tin oxide (ATO) is a material similar to ITO, but has a greatly reduced conductivity. Other films have also been tried, but either lack conductivity or desired optical properties.

Transparent thin film acoustic transducers also have many other diverse applications. For instance, thin film speakers can work as transparent compact and lightweight general-purpose flat-panel loudspeakers. Attaching transparent thin film speakers onto the surface of windows, computer screens, posters, and touch panels can enable them to be "speaker-integrated" devices. This provides displays that may be able to talk, and touch pads, and windows that can serve as invisible speakers, windows that can serve as media centers, and other applications. Further, transparent thin film microphones can work as invisible sound monitors for military applications.

SUMMARY

A thin film acoustic transducer is formed with an electrically actuatable substantially transparent thin film having a first side and a second side. Substantially transparent conductive thin films are supported by the first and second sides of the electrically actuatable substantially transparent thin film. The thin film transducer may be used to sense sound, or produce sound in various embodiments.

In further embodiments, the film may be attached to a window, computer monitor, touch panel and posters etc., and operate as a speaker for an audio system, or may provide noise cancellation functions.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

The functions or algorithms described herein may be implemented in software or a combination of software and firmware in one embodiment. The software comprises computer executable instructions stored on computer readable media such as memory or other type of storage devices. The term "computer readable media" is also used to represent carrier waves on which the software is transmitted. Further, such functions correspond to modules, which are software, hardware, firmware or any combination thereof. Multiple functions are performed in one or more modules as desired, and the embodiments described are merely examples. The software is executed on a digital signal processor, ASIC, microprocessor, or other type of processor operating on a computer system, such as a personal computer, server or other computer system.

Figure 1:
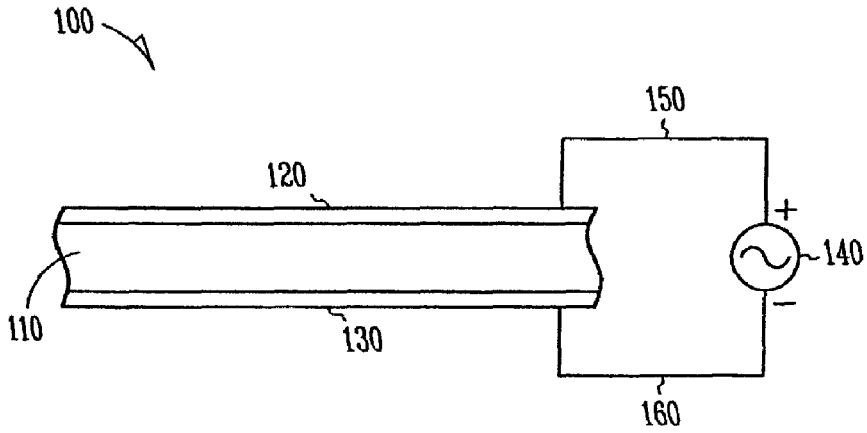
FIG. 1 is a block diagram of a thin film transparent acoustic transducer according to an example embodiment.

FIG. 1 is a block diagram of a thin film transparent acoustic transducer 100 according to an example embodiment. The thin film acoustic transducer 100 has an electrically actuatable substantially transparent thin film 110 having a first side and a second side. A first substantially transparent conductive thin film 120 is supported by the first side of the electrically actuatable substantially transparent thin film 110, and a second substantially transparent conductive thin film 130 is supported by the second side of the electrically actuatable substantially transparent thin film. A power source 140, such as an audio amplifier provides signals on electrode contact conductive lines 150 and 160 to respective conductive thin films to provide actuation of the electrically actuatable thin film 110, causing it to move in accordance with variations in an applied voltage, acting as an acoustic speaker in one embodiment.

In one embodiment, the electrically actuatable substantially transparent thin film 110 is formed of PVDF, having a piezoelectric effect. The thickness of the PVDF film may be varied depending on amount of acoustic energy desired. Thinner films require less voltage to actuate, while thicker films may require high voltages to actuate.

The conductive thin films 120 and 130 comprise carbon nanotubes, such as single-walled carbon nanotubes (SWNTs), and may also contain other forms of nanotubes, such as double-walled carbon nanotubes, multi-walled carbon nanotubes, and other carbon nanotube-based transparent conductive composite thin films. The conductive thin films in one embodiment are approximately 300 nm to 100 nm thick or thinner. Thinner layers provide higher transparency. Thicker films may also be used, but may not be as transparent. In one embodiment, the thickness is a tradeoff between transparency, and maintaining the quality of the film. As processes improve, thinner films may be more desirable. SWNTs in one embodiment have a high conductivity—$10^3$ to $10^4$ S/cm and high aspect ratio (>100) in one embodiment. The combination of the PVDF film and nanotube conductive films provide transparent thin film acoustic transducers with transparencies greater than 65% in one embodiment, with the carbon nanotube films each having a transparency of approximately 86% or better. In further embodiments, laminates may be used on the conductive films to protect them.

In further embodiments, other electrically actuatable substantially transparent thin films may be used, such as Semicrystalline Polymers —Poly(vinylidene fluoride) (PVDF) & its copolymers, such as Poly(vinylidene fluoride-trifluoroethylene) (PVDF-TrFE), Poly(vinylidene fluoride-tetrafluoroethylene) (PVDF-TFE). Polyamides (nylons) Polyureas may also be used. Amorphous Polymers include Polyvinylidene chloride (PVC), Polyacrylonitrile (PAN), polyphenylethemitrile (PPEN), poly(vinylidenecyanide vinylacetate) (PVDCN-VAc), (—CN) APB/ODPA. Ceramics include Lead Lanthanum Zirconium Titanate (PLZT), lead magnesium niobate-lead titanate (PMN-PT). Still further, other materials include zinc oxide (ZnO).

Yet further materials which are electrically actuable include electroactive dielectric polymer materials. These are not piezoelectric materials, but they also could replace the PVDF film in the transparent speaker application although they may not perform as well as PVDF. These materials are electrostatically actuated, such as Acrylic elastomers, silicone, polyvinyl alcohol (PVA)

Figure 2:
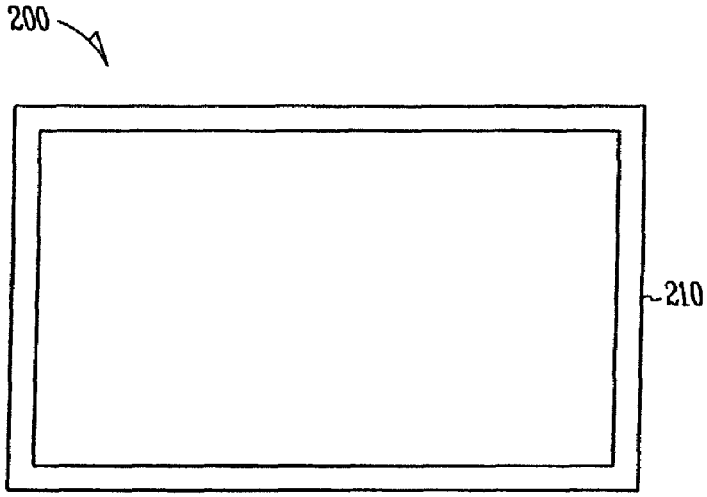
FIG. 2 is a block diagram of a thin film transparent acoustic transducer having means for coupling the transducer to a substrate according to an example embodiment.

FIG. 2 is a block diagram of a thin film transparent acoustic transducer 200 having means 210 for coupling the transducer to a substrate according to an example embodiment. In one embodiment, conductive tape is used as the means. Further means include the use of many different types of clamps, adhesive, and other materials. In one embodiment, means 210 comprises a frame, such as a picture frame holding outside edges of the transducer in a desired manner, such as by clamping or glue.

Figure 3:
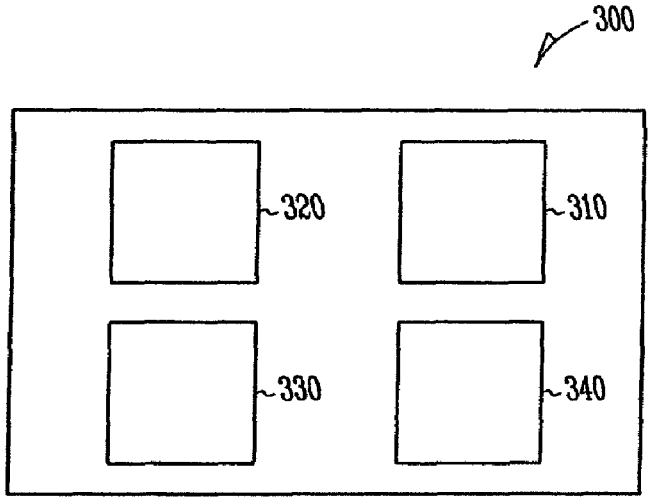
FIG. 3 is a block diagram of multiple sets of electrodes forming an acoustic multi-transducer thin film according to an example embodiment.

FIG. 3 is a block diagram of a multi-transducer thin film 300 according to an example embodiment. Multiple sets of opposed electrodes 310, 320, 330, 340, one on each side per set, form the multi-transducer thin film 300. Each electrode set corresponds to a portion of the electrically actuatable substantially transparent thin film. The sets may be separated by a non-conductive area of a film, or may be individually placed on the actuatable film. Sets of conductors may be coupled to each of the sets of opposed electrodes to provide for independent actuation of areas of the thin film. The conductors may be narrow enough to not detract from aesthetics when the film is placed on a window or pane that is normally transparent. Different sizes of electrodes may be formed to make speakers or transducers of various sizes. Smaller areas generally may provide a higher frequency response. By providing multiple different sized areas, sound quality may be optimized by using the different sizes for different frequency ranges.

Figure 4:
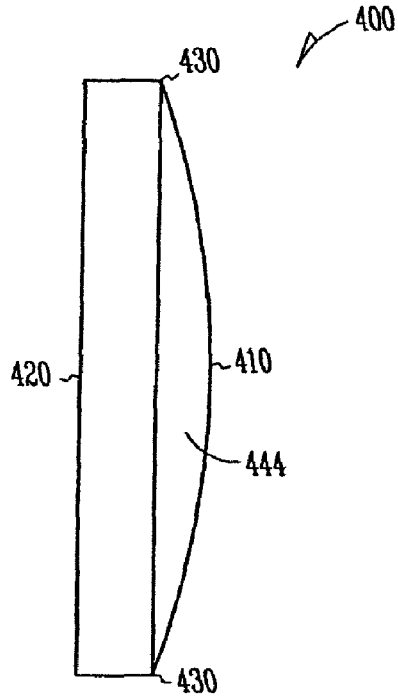
FIG. 4 is a block diagram of a thin film transparent acoustic transducer coupled to a substrate according to an example embodiment.

FIG. 4 is a block diagram cross section of a thin film transparent acoustic transducer 410 coupled to a substrate 420 with a tape 430. In one embodiment, the transducer is bowed away from the substrate, creating an air pocket 444 between the transducer and substrate. This allows the transducer to move when actuated, and produce desired acoustic energy. When used as a sensor, the air pocket 444 also allows the transducer to move larger distances when actuated, or in response to received acoustic energy, creating electrical signals responsive to the acoustic energy. In one embodiment, the film is under a desired amount of tension, facilitating uniform motion of the transducer.

Figure 5:
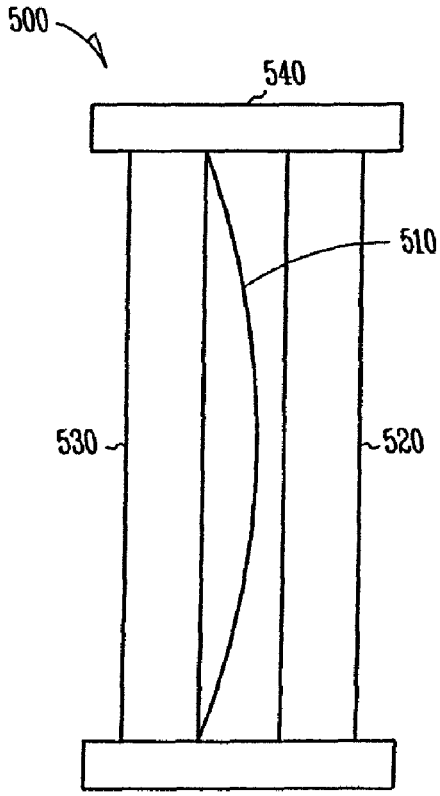
FIG. 5 is a block diagram of a thin film acoustic transparent transducer coupled between a doubled glazed window according to an example embodiment.

FIG. 5 is a block diagram of a thin film acoustic transparent transducer 510 coupled between a doubled glazed window 520, 530 according to an example embodiment. The transducer 510 may be coupled to one of the windows 530 and actuated in a manner similar to that in FIG. 4. Framing 540 holds the windows 520, 530 in place.

Figure 6:
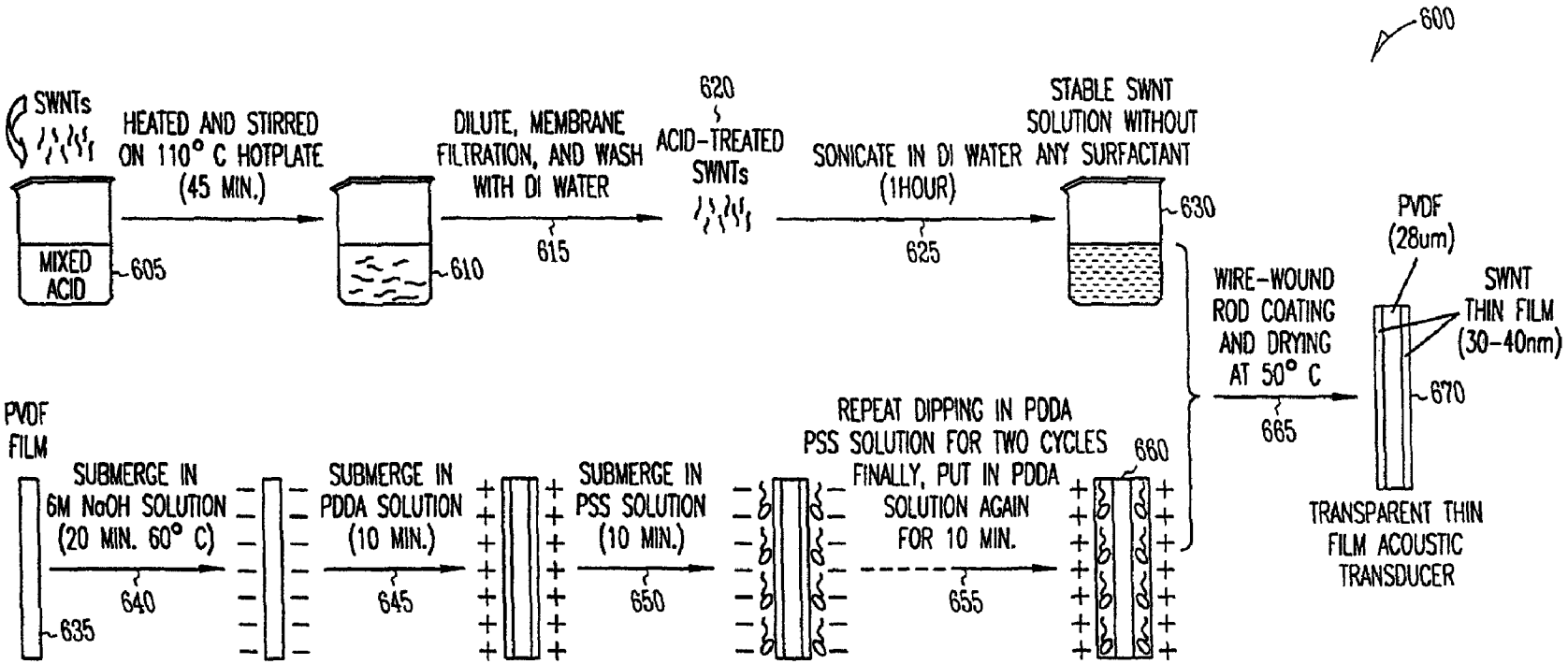
FIG. 6 is a process block diagram illustrating a method of forming a thin film transparent acoustic transducer according to an example embodiment.

FIG. 6 is a process block diagram illustrating a method 600 of forming a thin film transparent acoustic transducer according to an example embodiment. In one embodiment, single-walled carbon nanotubes (SWNTs) are chemically treated with a mixture of sulfuric acid and nitric acid, or other oxidant, such as oleum, at 605 for a long enough time so that a stable SWNT aqueous solution can be obtained without any surfactant. The carbon nanotubes are negatively charged due to the use of the oxidant. The surface of the PVDF substrate is modified with a layer by layer (LBL) nanoassembly technique, which introduces a positive charged and hydrophilic poly(diallyldimethylammonium chloride) (PDDA) molecular layer on the top of substrate surface. In one embodiment, PDDA is chosen for its high hydrophilicity among common polycations, but other positive charged and hydrophilic polycations may also be used. The acid treatment removes the need for surfactant in the films which greatly enhances the conductivity while retaining the excellent optical properties, while the positive charged and hydrophilic surface help to make a large size uniform SWNT thin film and increase the bonding force between SWNTs and the substrate.

High purity SWNTs (<10% impurity) for this study were supplied by Timesnanoweb (Chengdu, China), which were synthesized using chemical vapor deposition (CVD) method. In a typical acid treatment procedure, 100 mg nanotubes are added to 40 ml of acid mixture of sulfuric acid (98 wt %) and nitric acid (69 wt %) in a ratio of 3:1, and stirred for 45 min on a 110° C. hot plate at 605. Other ratios, such as 1:1, 2:1 and 4:1 or possibly higher may also be used. The resulting suspension 610 is then diluted to 200 ml. Finally, the SWNTs were collected by membrane filtration (0.45 μm pore size) at 615, and washed with enough deionized (DI) water to remove residual acids. The acid treated SWNTs 620 (10 mg) was added into 10 ml of DI water and bath ultrasonicated for 1 hour at 625 and settled for a few hours at room temperature at 630.

The substrate, 250 mm×190 mm ×28 μm PVDF thin film indicated at 635 (Measurement Specialties Inc, VA), may be firstly hydrolyzed with 6M NaOH aqueous solution for 20 min at 60° C. at 640. After rinsing with DI water, PET film was immersed in 1.5 wt % PDDA solution at 645 (with 0.5 M NaCl) for 15 min at room temperature, followed by rinsing with DI water. PVDF film was then dipped into 0.3 wt % poly(sodium styrenesulfonate) (PSS) (with 0.5 M NaCl) for 15 min and rinsed. The PDDA/PSS adsorption treatment was repeated for two cycles at 655 and finally treated with PDDA solution again. The outer most layer is thus the positively charged PDDA molecular layer as shown at 660. The SWNT/water solutions were then applied to both sides of the PVDF film by wire-wound rod coating and dried at 50° C. at 665. They may be dried at other temperatures not exceeding approximately 70° C. in further embodiments. After drying, additional SWNT layers could be coated above the initial SWNT layer to achieve a desired combination of electrical and optical properties. This comprises a layer by layer nanoassembly process using a positively charged hydrophilic polymer molecule layer formed on the top of the substrate. The final SWNT thin film 670 is about 30~40 nm, with a surface resistivity of 2.5 KOhms/□. In further embodiments, the thickness of the thin film 670 may vary between approximately 10 nm to over 100 nm, and the surface resistivity may very between approximately 0.5 KOhms/□ to over 100 KOhms/□.

Many of the above parameters may be varied significantly without departing from the scope of the invention. Further, this is just one method of forming the transparent thin film speaker. Other methods may be used. As indicated above, many different combinations of materials may also be used, using yet different processes.

Figure 7:
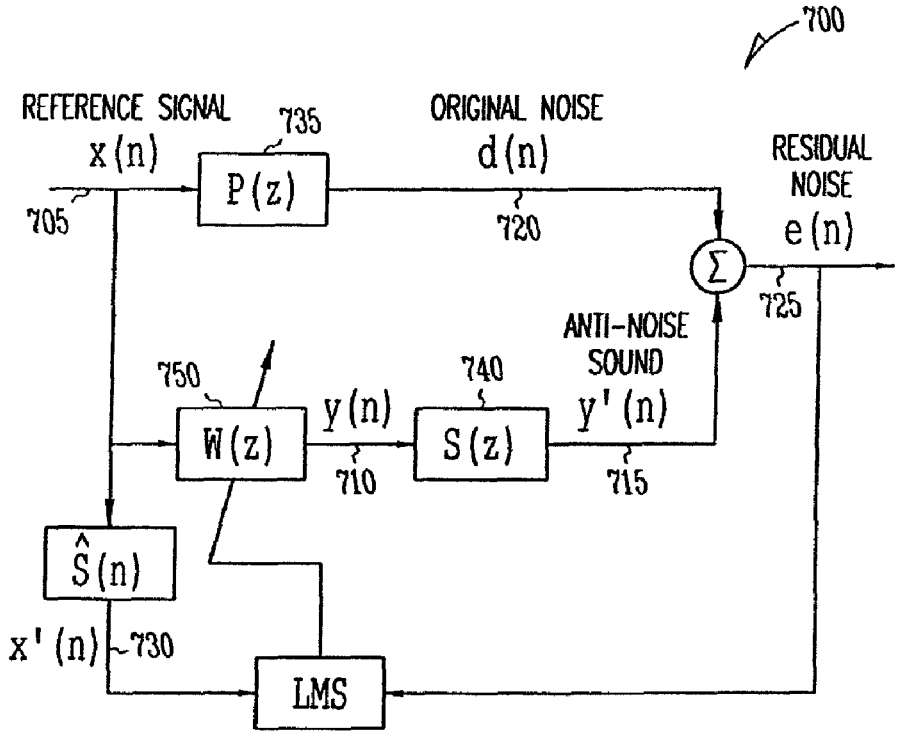
FIG. 7 is a block diagram of a feedforward controller for a thin film transparent speaker according to an example embodiment.

FIG. 7 is a block diagram of a feedforward controller 700 for a thin film transparent speaker according to an example embodiment. A feedforward FXLMS (filtered-X least mean square) algorithm is used in one embodiment. In FIG. 7, x(n) is the reference signal 705; y(n) is a desired control (speaker) signal 710; y'(n) is the actual sound 715 of the secondary source; d(n) is the undesired primary noise 720; e(n) is the residual noise 725 at downstream measured by an error microphone; x'(n) is the filtered version 730 of x(n); P(z) 735 is the unknown transfer function between the reference microphone and the secondary source; S(z) 740 is the dynamics from the secondary source to the error microphone; $\hat{S}(z)$ 745 is the estimation of this secondary path; and W(z) 750 is the digital filter that is adapted to generate the correct control signals to the secondary source. The objective is to minimize e(n) via minimizing the instantaneous squared error, $\hat{\xi}(n)=e^2(n)$. The most widely used method to achieve this is the filtered-x least mean square (FXLMS) algorithm, which updates the coefficients of W(z) in the negative gradient direction with appropriate step size μ:

$$\vec{w}(n+1) = \vec{w}(n) - \frac{\mu}{2}\nabla\hat{\xi}(n) \tag{1}$$

where $\nabla\hat{\xi}(n)$ is the instantaneous estimate of the mean square error gradient at time n, and can be expressed as $$\begin{aligned}\nabla\hat{\xi}(n) &= 2[\nabla e(n)]e(n) \\ &= 2[-s(n)*x(n)]e(n) \\ &= -2x'(n)e(n)\end{aligned} \tag{2}$$

By substituting the above equation back into (1), we have the fixed X least mean square (FXLMS) algorithm, $$\vec{w}(n+1)=\vec{w}(n)+\mu x'(n)e(n) \tag{3}$$

where x'(n) is estimated as $\hat{s}(n)*x(n)$.

Figure 8:
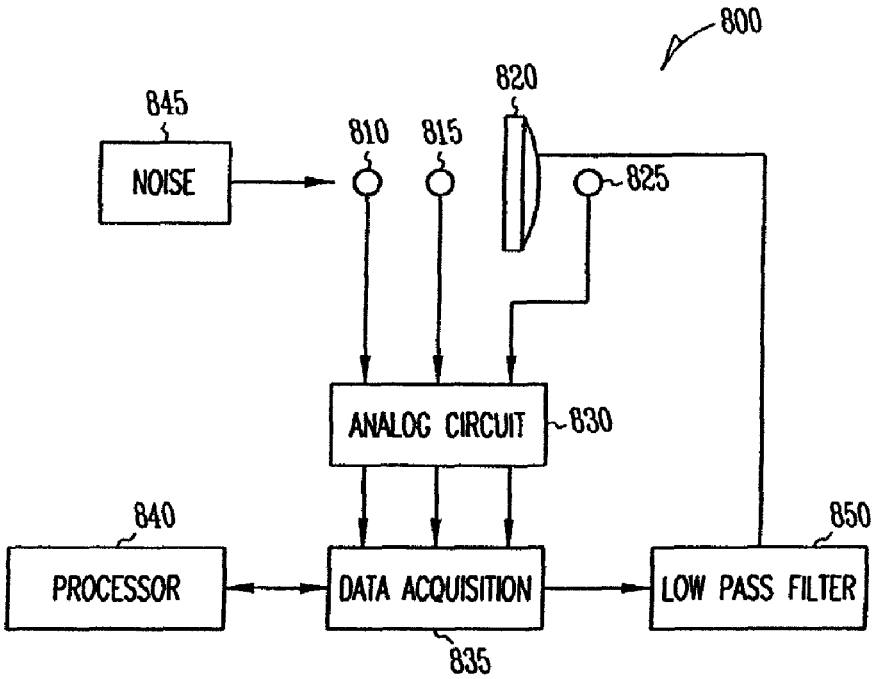
FIG. 8 is a block diagram illustrating sound transmission control for a thin film transparent speaker according to an example embodiment.

FIG. 8 is a block diagram illustrating a sound transmission control system 800 for a thin film transparent speaker 805 according to an example embodiment. Two reference microphones 810, 815 are used to separate incident noise from noise reflected from a glass panel 820 having speaker 805 coupled thereto, so as to provide a better reference signal. Another microphone 825 at the other side of the panel 820 measures the residual sound pressure which is then controlled to zero. An analog circuit 830 provides functions of amplification and filtering. A CIO-DAS6402/12 data acquisition device 835 is used to support data communication between a controller, such as a processor 840 and the speakers/microphones. The control algorithm may be implemented via a PC real time toolbox with Turbo C used to develop the real-time code, with processor 840 comprising a personal computer in one embodiment. The output is run through a low pass filter 850 prior to actuating the speaker via conductor 855 coupled to the speaker 820. The analog circuit, data acquisition, low pass filter and processor functions may be implemented in software, hardware or combinations of software, hardware and firmware. A single chip or circuit board may be used to perform such functions.

The primary noise represented at 845 consists of multi-frequency components. Residual acoustic pressure at the error microphone 825 may be significantly reduced by a factor of more than 6. The measured sound reductions are in the range of 10-15 dB. The sound transmission control system

800 is able to attenuate the random primary noise by a factor of two. The primary noise may be reduced at almost every frequency. Although there may be less reduction for frequencies below 500 Hz, the thin film speaker 825 may perform well above 500 Hz. The overall sound level reduction is about 6 dB. The reason of less sound reduction in low frequencies is due to the weaker acoustic response of the thin film speaker in the low frequency range.

Transparent thin film acoustic actuators described herein may be used for active sound transmission control for windows. The carbon nanotube based transparent conductive thin films significantly enhanced the acoustic response of the thin film transducers. With the advantages of being flexible, transparent and lightweight, the thin film speakers may provide a promising solution for sound transmission control for windows. Global sound reduction may be achieved with the developed transparent thin film speaker. With flat response over a broad band frequency range, the transparent thin acoustic actuator may also be used as a general-purpose loudspeaker. With the use of PVDF, a piezoelectric material, the piezoelectric effect creates an electric signal that can be monitored as the acoustic pressure acts on the film surface. Therefore, the PVDF thin film may also be utilized as an acoustic sensor, such as a microphone.

The Abstract is provided to comply with 37 C.F.R. §1.72(b) to allow the reader to quickly ascertain the nature and gist of the technical disclosure. The Abstract is submitted with the understanding that it will not be used to interpret or limit the scope or meaning of the claims.

The invention claimed is:

1. A speaker comprising: a piezoelectric substantially transparent thin film polymer having a first side and a second side; a first thin film coating of conductive carbon nanotubes supported by the first side of the piezoelectric thin film polymer; and a second thin film coating of conductive carbon nanotubes supported by the second side of the piezoelectric thin film polymer, wherein the conductive carbon nanotube thin films are substantially transparent and are approximately 100 nm or less in thickness.

2. The speaker of claim 1, wherein the piezoelectric film comprises polyvinylidene fluoride.

3. The speaker of claim 1 and further comprising a frame coupled to outside edges of the films.

4. The speaker of claim 1 and further comprising a substrate, and wherein the films are coupled to outside edges of the films.

5. The speaker of claim 4 wherein the film is bowed away from the substrate.

6. The speaker of claim 5 wherein the film is under tension.

7. The speaker of claim 4 wherein the substrate comprises double glazed window, and wherein the films are coupled between two panes of the double glazed window.

8. The speaker of claim 1 having a transparency of at least approximately 65%.

9. The speaker of claim 1 wherein the thin film coatings of conductive carbon nanotubes have a conductivity of at least $10^3$ S/cm.

10. A thin film transparent acoustic transducer comprising: an electrically actuatable substantially transparent piezoelectric thin film having a first side and a second side; a first substantially transparent conductive thin film supported by the first side of the electrically actuatable substantially transparent thin film; and a second substantially transparent conductive thin film supported by the second side of the electrically actuatable substantially transparent thin film, wherein the substantially transparent conductive thin films comprise films of approximately 100 nm or less in thickness.

11. The thin film acoustic transducer of claim 10, wherein the electrically actuatable substantially transparent thin film comprises polyvinylidene fluoride.

12. The thin film acoustic transducer of claim 10, wherein the first and second conductive thin films comprise films of carbon nanotubes, carbon nanofibers, graphene, or combinations thereof.

13. The thin film acoustic transducer of claim 10 and further comprising a controller that provides electrical signals to the conductive thin films to actuate the electrically actuatable substantially transparent thin film.

14. The thin film acoustic transducer of claim 10 wherein the electrically actuatable substantially transparent thin film produces acoustic energy in response to electrical signals applied across the conductive thin films.

15. The thin film acoustic transducer of claim 10 having a transparency of at least approximately 65%.

16. The thin film transparent acoustic transducer of claim 10 and further comprising:

a microphone for sensing noise to be cancelled;

an electrically actuatable substantially transparent piezoelectric thin film having a first side and a second side;

a first substantially transparent conductive thin film supported by the first side of the electrically actuatable substantially transparent thin film;

a second substantially transparent conductive thin film supported by the second side of the electrically actuatable substantially transparent thin film;

means for actuating the electrically actuatable substantially transparent thin film as a function of the sensed noise.

17. The thin film transparent acoustic transducer of claim 16 and further comprising a window on which the thin films are supported.

18. A thin film acoustic transducer comprising: an electrically actuatable substantially transparent piezoelectric thin film having a first side and a second side; a first thin film coating of conductive carbon nanotubes, carbon nanofibers, graphene, or combinations thereof supported by the first side of the electrically actuatable substantially transparent thin film; and a second thin film coating of conductive carbon nanotubes, carbon nanofibers, graphene, or combinations thereof supported by the second side of the electrically actuatable substantially transparent thin film, wherein the carbon nanotube, carbon nanofibers, graphene, or combinations thereof thin films are substantially transparent conductive thin films approximately 100 nm or less in thickness.

19. The thin film acoustic transducer of claim 18 and further comprising multiple sets of opposed thin film coatings of conductive carbon nanotubes coupled to the sides of the electrically actuatable substantially transparent thin film, each capable of actuating a corresponding portion of the electrically actuatable substantially transparent thin film.

* * * * *